US005087134A

United States Patent [19]

Tanuma et al.

[11] Patent Number: 5,087,134

[45] Date of Patent: Feb. 11, 1992

[54] METHOD OF AND DEVICE FOR PRINTER CONTROL

[75] Inventors: Jiro Tanuma; Hideaki Ishimizu; Tadashi Kasai; Chihiro Komori, all of Tokyo, Japan

[73] Assignee: Oki Electric Industry Co., Ltd., Tokyo, Japan

[21] Appl. No.: 504,140

[22] Filed: Apr. 3, 1990

[30] Foreign Application Priority Data

Apr. 7, 1989 [JP] Japan ..... 1-87093

[51] Int. Cl.[5] ..... B41J 29/387

[52] U.S. Cl. ..... 400/54; 400/74

[58] Field of Search ..... 400/63, 65, 54, 322, 400/320, 74, 551, 568

[56] References Cited

U.S. PATENT DOCUMENTS

| | | | |
|---|---|---|---|
| 4,180,335 | 12/1979 | Yamada | 400/322 |
| 4,210,404 | 7/1980 | Hanger | 400/124 |
| 4,226,546 | 10/1980 | Hoffman | 400/322 |
| 4,600,319 | 7/1986 | Everett, Jr. | 400/54 |
| 4,600,319 | 7/1986 | Everett, Jr. | 400/52 |
| 4,653,941 | 3/1989 | Suzuki | 400/54 |
| 4,669,900 | 6/1987 | Miyake et al. | 400/903 |
| 4,687,361 | 8/1987 | Kikuchi et al. | 400/322 |
| 4,701,685 | 10/1987 | Gzüner | 400/322 |
| 4,759,648 | 7/1988 | Kobayashi et al. | 400/568 |
| 4,772,140 | 9/1988 | Arauchi | 400/54 |
| 4,785,312 | 11/1988 | Toyomura | 400/54 |

FOREIGN PATENT DOCUMENTS

| | | | |
|---|---|---|---|
| 0079189 | 6/1980 | Japan | 400/54 |
| 0101488 | 8/1980 | Japan | 400/54 |
| 0022184 | 3/1981 | Japan | 400/54 |
| 0014074 | 1/1982 | Japan | 400/54 |
| 0025982 | 2/1982 | Japan | 400/54 |
| 0217383 | 12/1983 | Japan | 400/54 |
| 0059464 | 4/1984 | Japan | 400/54 |
| 0202879 | 9/1986 | Japan | 400/54 |

OTHER PUBLICATIONS

Patent Abstracts of Japan; vol. 7, No. 81 (M-205) (1226) 5, Apr. 1983, & JP-A-58 7386 (Tatara) 17 Jan. 1983.

Patent Abstracts of Japan, vol. 8, No. 249 (M-338) (1986), 15 Nov. 1984, & JP-A-59 124881 (ABE) 19 Jul. 1984.

Patent Abstracts of Japan, vol. 10, No. 118 (M-475) (2175) 2 May 1986, & JP-A-60 248379 (Watanabe) 9 Dec. 1985.

*Primary Examiner*—Edgar S. Burr

*Assistant Examiner*—John S. Hilten

*Attorney, Agent, or Firm*—Wenderoth, Lind & Ponack

[57] ABSTRACT

In a printer in which a print head and a print medium are moved relative to each other in a spacing direction and in a line-feed direction, the position of the print head in the spacing direction is detected, and the stoppage of the print head during a spacing operation is detected, and the stop position in the spacing direction is stored. When the print head stops, reverse line-feed is performed by a first amount. The spacing operation is then performed in the same direction as before the carriage stopped. A forward line-feed is then performed by the first amount, and then the spacing operation is performed in the opposite direction. If the print head stops again at the same stop positon, an error indication is made. If the print head does not so stop, the spacing operation is continued.

7 Claims, 3 Drawing Sheets

31: PRINT MEDIUM
FORWARD DIRECTION
REVERSE DIRECTION
REVERSE LINE-FEED
FORWARD LINE-FEED
STOP POSITION
32
103
101
109
102
104
106
107
105

31
33
32

32
33

1
2
3
4
5
6
7
8

METHOD OF AND DEVICE FOR PRINTER CONTROL

BACKGROUND OF THE INVENTION

The present invention relates to a method of and a device for controlling a serial printer, such as a dot matrix printer, and particularly to a method of controlling the spacing operation and line-feed operation when the normal spacing is obstructed.

Dot matrix printers have a print head and an ink ribbon cassette mounted on a carriage. The print head has print wires that are selectively driven toward a print medium on a platen. Printing is achieved by selectively driving the print wires while moving the carriage laterally across the print medium. This lateral movement is called spacing. The spacing is conducted in the forward direction (from the left to the right, as seen from the front of the platen) or in both forward and reverse directions. After printing of each line is completed, the print medium is moved (by moving the platen, for example) longitudinally by one line. This longitudinal movement is called line-feed. A sequence consisting of printing while spacing and then line-feed is repeated to perform printing over all the surface of the print medium. In such a printer the tip of the print head is disposed close the the surface of the print medium. It is therefore possible that the print head may be stopped by abutment with a projection of a print medium.

This will be described in further detail with reference to FIG. 4, which is a partial perspective view of a carriage in a conventional dot matrix printer.

As illustrated, a print head 1 is mounted on a carriage frame 2, and is disposed such that it is capable of sliding, together with the carriage, to the right and to the left on a carriage shaft 3. A space motor 4 is mounted on the carriage. The stator of the space motor 4 is also the carriage frame 2.

When the space motor 4 rotates, the pinion 5 rotates to move the space rack 6 back and forth, with the result being that the carriage on which the space motor 4 is mounted is moved to the right and to the left.

Provided on the carriage is a slit disk 7 which moves together with the space motor 4. A pulse generator 8 comprises a light-emitting element such as a light-emitting diode, and a photosensor disposed to receive light from the light-emitting element, and produces pulses at a rate proportional to the rotational speed of the space motor 4.

In the above dot matrix printer, the print head 1 is moved in the forward and reverse directions (this operation is the spacing operation), and at timings in synchronism with the spacing operation, the print wires of the print head 1 are struck against the print medium on the platen, so that printing is effected.

When printing of each line ends, the print medium on the platen is line-fed by means of the line-feed motor, and the print head 1 is moved to the position at which the printing of the next line begins, and printing is again started.

During printing, when the load on the carriage is temporarily increased, or when the torque of the space motor 4 is temporarily decreased, the carriage may stop, causing an error.

In such a case, even when the operator tries to restart the printer, the spacing operation will not be resumed unless the cause of the stoppage of the carriage is removed.

A solution in the prior art is to increase the torque of a space motor 4, making the occurrence of the carriage stoppage more difficult. However, this was undesirable because of the resultant increase in the size and the cost of the space motor 4 and the motor drive circuit. Recently, a control device has been proposed in which the carriage control is achieved without increasing the torque of the space motor 4.

In this control device, when the carriage is stopped, it is moved backward to the original position, i.e., where the spacing operation is started, and then the carriage is again moved forward. If the carriage is stopped again at the same position, recognition is made that the error is not recoverable and an error indication is made. If the carriage is not stopped, the spacing operation is continued and the printing is resumed.

It is, however, often the case that the cause of the stoppage of the carriage is not removed by such an operation, and rather the situation becomes worse by such an operation. This is true where the cause of the stoppage is abutment of the print head with a projection of multiple sheet paper (consisting of several sheets laminated with each other). An example of such a multiple sheet paper is shown in FIG. 5A and FIG. 5B, which are a cross sectional view and a perspective view, respectively. The multiple sheet paper 31 having feed perforations 32 is provided with a projection 33 in the form of an embossment or piercing provided to hold the sheets together. In such a case, sheets of the multiply paper may be turned over by abutment with the print head, and the projection becomes higher such that the projection is not eliminated but rather becomes worse.

SUMMARY OF THE INVENTION

An object of the invention is to solve the above problems of the prior art control device, and to provide a control device that is capable of carrying out a spacing operation without stopping the carriage even under a heavy carriage load.

A printer control device according to the invention is for a printer in which the spacing operation of a print head and line-feed operation of a print medium are performed. It comprises:

(a) line-feed means for performing the line-feed of the print medium;

(b) spacing means for performing the spacing operation of the print head;

(c) means for detecting the position of the print head in the direction of spacing;

(d) means for detecting the stoppage of the print head during spacing operation;

(e) stop position memory for storing the position of the print head in the direction of the spacing when the print head is found to have stopped; and (f) control means for causing the line-feed means to perform reverse line-feed by a first amount when the print head stops, causing the spacing means to perform the spacing operation in the same direction as before the print head has stopped, causing the line-feed means to perform forward line-feed by said first amount, and causing the spacing means to perform the spacing operation in the opposite direction;

(h) said stoppage detecting means detecting the stoppage during the spacing in said opposite direction as well; and (i) said control means being responsive to said stoppage detecting means and performing an error indication when the print head stops at the position at which it has stopped, and continuing the spacing operation if the carriage does not stop at the stop position.

The term "reverse line-feed" is used to mean line-feed in the direction opposite to normal line-feed or "forward line-feed".

During the reverse spacing to the stop position, printing may also be carried out.

DETAILED DESCRIPTION OF THE PREFERRED EMBODIMENTS

An embodiment of the invention will now be described with reference to the drawings.

Figure 1:
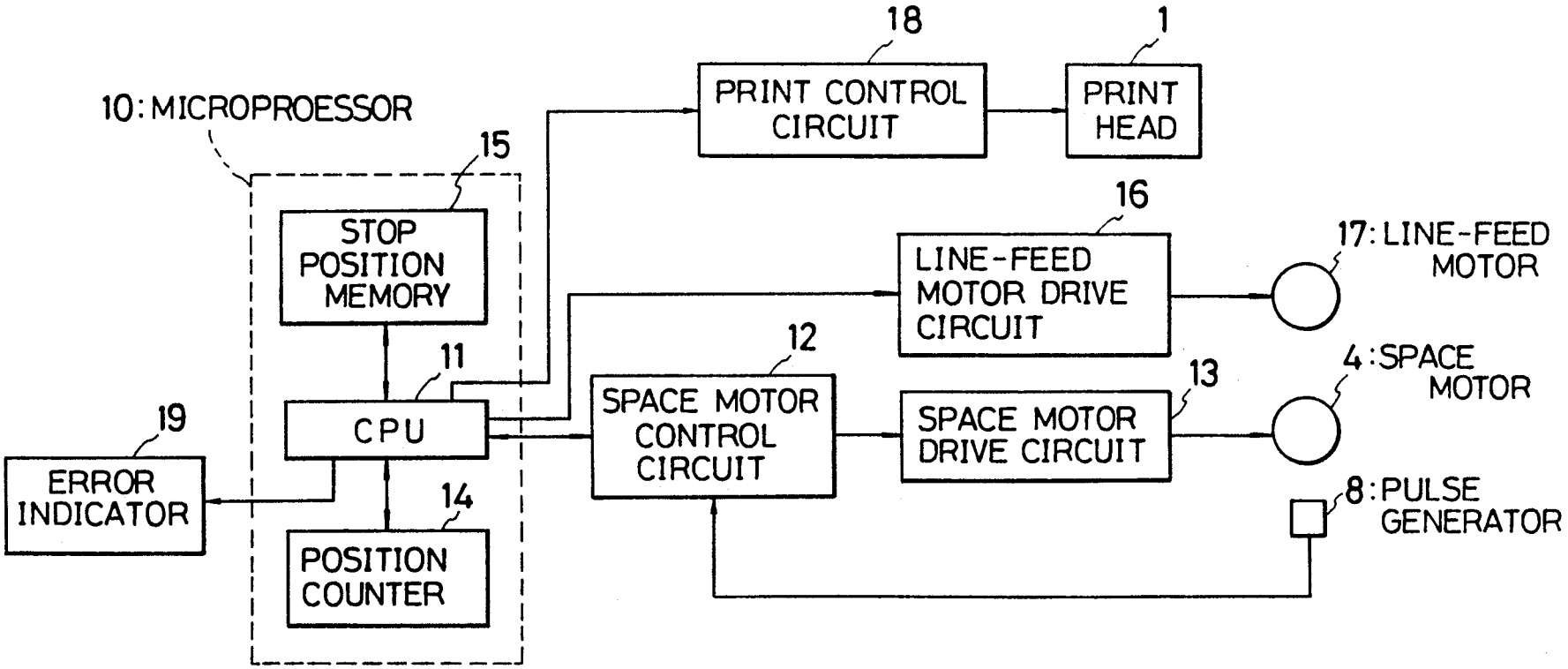
FIG. 1 is a block diagram of the control device according to the invention.
Figure 2:
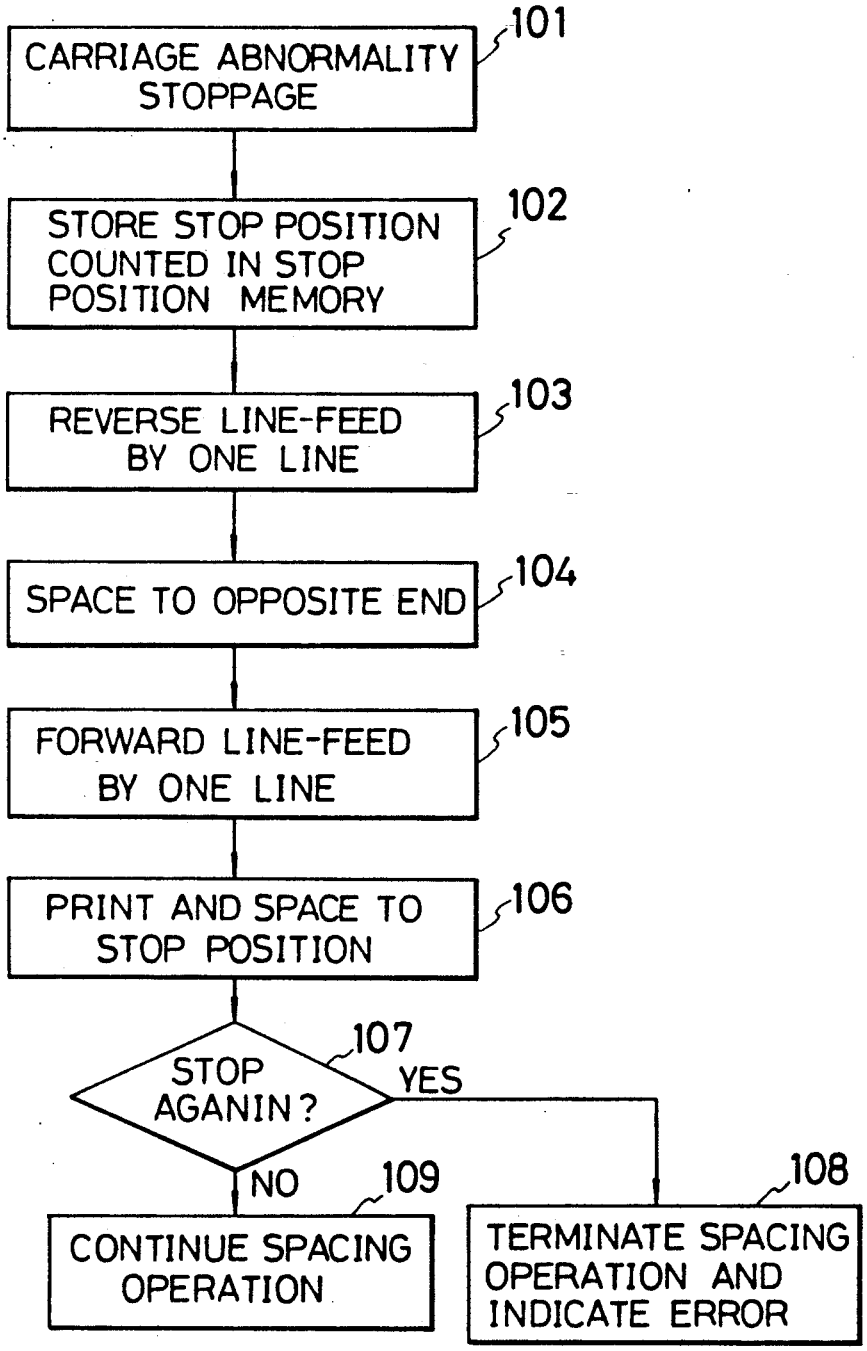
FIG. 2 is a flowchart showing the operation of the control device according to the invention.
Figure 3:
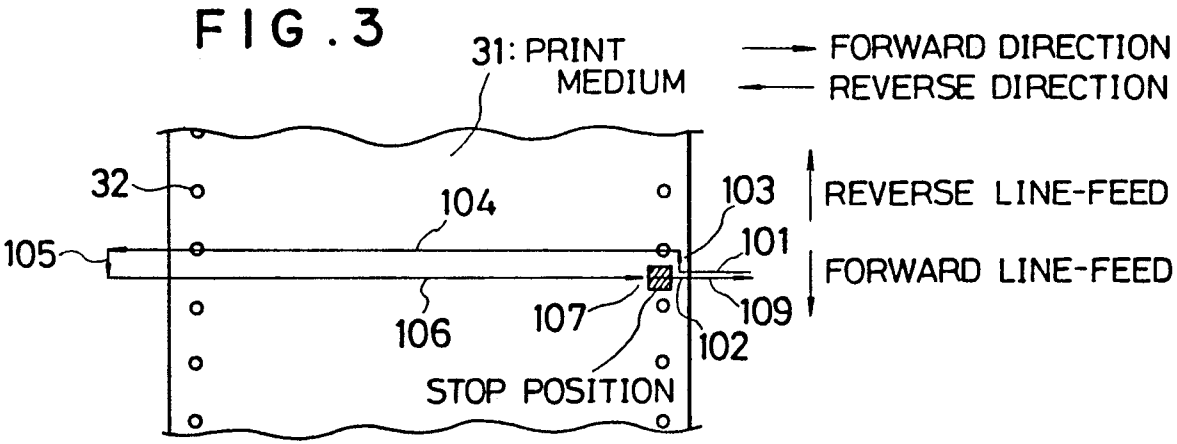
FIG. 3 is a diagram for explaining the variation in the position of printing corresponding to the flowchart of the operation of FIG. 2.
Figure 5B:
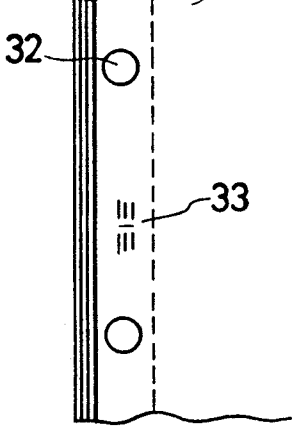
FIG. 5A and FIG. 5B are a cross section and a perspective view of a multiple sheet paper having a projection.
Figure 5A:
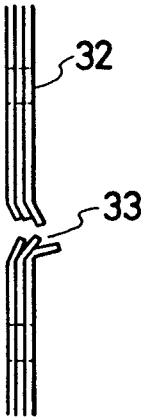

FIG. 1 is a block diagram of the printer control device according to the invention. FIG. 2 is a flowchart showing the operation of the printer control device according to the invention. FIG. 3 is a diagram showing the positions of the print head at the respective steps in the flowchart of FIG. 2.

Figure 4:
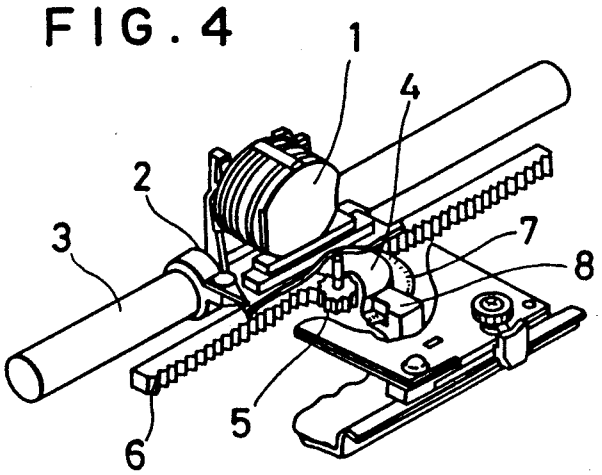
FIG. 4 is a partial perspective view of a carriage in a conventional dot matrix printer.

The control system of this embodiment is for a serial printer which is described with reference to FIG. 4.

As illustrated, a microprocessor 10 comprises a CPU 11 for performing control over the entire operation of the dot matrix printer. Specifically, the microprocessor 11 performs control over the spacing operation, and the line-feed operation, as in the conventional printer, as well as spacing and line-feed for recovery from the stoppage of the carriage due to the presence of a projection or the like on the printing medium. The microcomputer 10 also comprises a ROM, a RAM, I/O ports, etc., not shown as such. The ROM stores a program shown by the flowchart of FIG. 2.

A print control circuit 18 is for controlling the print head 1 for the purpose of printing.

A space motor control circuit 12 is for performing control over the operation of the space motor 4.

A space motor drive circuit 13 is responsive to the timing signals from the space motor control circuit 12 for driving the space motor 4.

A pulse generator 8 produces two series of pulses in synchronism with the rotation of the space motor 4. The frequency of the pulses is therefore proportional to the rotational speed of the space motor 4, and the relative phase of the two series of the pulses differ depending on the direction of the rotation of the space motor 4, i.e., the direction of the spacing. By processing the pulses from the pulse generator 8, it is therefore possible to determine the position of the carriage.

The output of the pulse generator 8 is supplied to the space motor control circuit 12 where it is converted into single-phase pulses whose frequency is proportional to the rotational speed of space motor and a signal indicating the direction of the rotation of the space motor 4.

The pulses and the direction indicating signal are supplied to the CPU 11 and to the position counter 14. The position counter 14 up-counts or down-counts the pulses depending on whether the direction indicating signal indicates the forward or reverse direction.

The CPU 11 detects the stoppage of the carriage in accordance with the pulses. That is if the frequency of the pulses becomes zero during the spacing operation, i.e., when the commands for spacing operation is issued, recognition is made that the carriage has stopped.

A stop position memory 15 stores the count value of the position of the counter 14 when the carriage stops. For this purpose, the stop position memory 15 receives, from the position counter 14, information on the stop position in the spacing direction.

The position counter 14 and the stop position memory 15 may be formed of part of the RAM in the microcomputer 10.

A line-feed motor drive circuit 16 is responsive to commands from a microprocessor 21 for driving a line-feed motor 17.

The stop position memory 15 also stores the amount by which the line feed is made in either direction. For this purpose, the stop position memory 15 receives, from the CPU 11, data indicating the amount of reverse line-feed that are contained in the commands which the CPU sends to the line-feed motor when the reverse line-feed is to be made because of the stoppage of the carriage.

An error indicator 19 is a light-emitting diode which is turned on when an unrecoverable error is recognized to indicate the error.

The operation of the control device according to the invention will be described with reference to FIG. 2 and FIG. 3.

The positions of the carriage at the respective steps in FIG. 2 are indicated by the same numerals in FIG. 3.

Step 101

When, on the basis of the pulses from the pulse generator 8, the CPU 11 detects stoppage of the carriage due to abnormality in the spacing operation while the dot matrix printer is printing in one direction, e.g., the reverse direction, it produces a control signal indicating the abnormality of the carriage.

Step 102

Then, the CPU 11 receives the data on the stop position in the spacing direction that is counted by the position counter 14, and stores the data in the stop position memory 15.

Step 103

The CPU 11 supplies a line-feed motor drive signal to the line-feed motor drive circuit 16, and performs reverse line-feed by one line. The amount (one line in this example) by which the reverse line-feed is made is stored in the stop position memory. Such an amount is known from the commands issued by the CPU 11 to the line-feed motor drive circuit 16.

Step 104

The CPU 11 supplies the space motor drive signal through the space motor control circuit 12 to the space motor drive circuit 13, and moves the carriage in the same direction as before it stops, i.e., in the reverse direction, and stops at the position opposite to the print start position, i.e., print end position.

Step 105

Then, forward line-feed is performed by the same amount (one line) that is stored in the stop position memory 15.

Step 106

The microprocessor 11 then changes the direction of movement of the carriage to the forward direction, and moves the carriage while performing printing by means of the print control circuit 18 and the print head 1, the data for the printing being for the line on which the printing was interrupted because of the stoppage of the carriage. The spacing and the printing is continued to the stop position, i.e., the position at which the position data in the position counter 14 coincide with the position data in the spacing direction as stored in the stop position memory 15.

Step 107

A determination is made whether or not the carriage again stops at the stop position.

Steps 108 and 109

When the carriage stops again, recognition is made that the error is unrecoverable, and the spacing operation is terminated and the error indication is made by means of the error indicator 19. When the carriage does not stop, the spacing operation is continued further.

As has been described according to the invention, when the carriage stops, the stop position that is counted by the position counter is stored in the stop position memory. Then, reverse line-feed is made, and the carriage is then moved in the same direction as before the carriage has stopped, to the position at which the printing ends, and subsequently, forward line-feed is performed by the same amount as the above reverse line-feed, and the carriage is moved while printing the print data that has not been printed to the stop position. If the carriage stops at the same position, the processing is terminated and error indication is made. When the carriage does not stop, the spacing operation is continued. Accordingly, even when there is a projection due, for example, to embossment or piercing in multiple sheet paper, the possibility of occurrence of turn-over of the paper is reduced, and the load on the carriage is reduced.

Accordingly, in the event of a temporary abnormality, the spacing operation is automatically resumed, and restarting with operator's intervention is obviated, so that the work efficiency of the printer is improved.

The invention is not limited to the above embodiment, but various modifications are possible within the spirit of the invention, and these modifications are not excluded from the scope of the invention.

For instance, the above description is made on the control of printing in the reverse direction. But for the control of printing operation in the forward direction, the same operation may be performed with the exception that the "reverse direction" and the "forward direction" in the above description are interchanged.

In the above description, the amount of reverse line-feed and the forward line-feed is one line, but any amount of line-feed may be set as long as it is possible to avoid the stop position.

What is claimed is:

1. A printer control device for a printer in which a spacing operation of a print head and a line-feed operation of a print medium are performed, comprising:

(a) line-feed means for performing the line-feed operation of the print medium;

(b) spacing means for performing the spacing operation of the print head;

(c) means for detecting the position of the print head in a spacing direction;

(d) means for detecting a stoppage of the print head during the spacing operation;

(e) stop position memory means for storing the stop position of the print head in the spacing direction when stoppage of the print head is detected; and (f) control means for causing the line-feed means to perform a line-feed operation in a reverse direction by a first amount when the stoppage of the print head is detected, then causing the spacing means to perform a spacing operation in a first direction which is the same as a direction of the spacing operation before the stoppage of the print head was detected, then causing the line-feed means to perform a line-feed operation in a forward direction by said first amount, and then causing the spacing means to perform a spacing operation in a second direction which is opposite the first direction;

(h) said stoppage detecting means for detecting a stoppage of the print head during the spacing operation in the second direction as well; and (i) said control means, responsive to said stoppage detecting means, for performing an error indication when stoppage of the print head is detected at the stop position stored in said stop position memory means during the spacing operation in the second direction, and continuing the spacing operation if stoppage of the print head is not detected at the stop position.

2. The device of claim 1, wherein said control means causes said spacing means to perform the spacing operation in the first direction to an end position where the spacing operation would have ended if stoppage of the print head had not been detected, and wherein said control means includes means for effecting printing of the print medium during said spacing operation in the second direction to the stop position.

3. The device of claim 1, wherein said line-feed means comprises (a1) a line-feed motor for performing line-feed of a print medium disposed on a platen;

(a2) a line-feed motor drive circuit for driving said line-feed motor; and said spacing means comprises:

(b1) a space motor for moving a carriage the first and second directions;

(b2) a space motor drive circuit for driving said space motor; and (b3) a space motor drive control circuit for controlling said space motor drive circuit.

4. The device of claim 1, wherein said position detecting means comprises (c1) a pulse generator for producing pulses in synchronism with a rotation of a space motor; and (c2) a position counter for counting the pulses produced by said pulse generator.

5. The device of claim 4, wherein said stoppage detecting means is responsive to said pulse generator.

6. A method of controlling a print head in response to an abnormal stoppage of the print head, comprising the steps of:

(a) performing a first spacing operation of the print head in a first direction;

(b) detecting a position of the print head in a spacing direction;

(c) detecting a stoppage of the print head during the first spacing operation in the first direction;

(d) storing a stop position of the print head when stoppage of the print head is detected;

(e) performing a line-feed operation in a reverse direction by a first amount when stoppage of the print head is detected;

(f) performing a second spacing operation in the first direction after the line-feed operation in the reverse direction;

(g) performing a line-feed operation in a forward direction by the first amount after the second spacing operation;

(h) performing a third spacing operation in a second direction which is opposite the first direction after the line-feed operation in the forward direction;

(i) detecting a stoppage of the print head during the third spacing operation in the second direction;

(j) providing an error indication when stoppage of the print head is detected at the stop position during the third spacing operation; and (k) continuing the third spacing operation if stoppage of the print head is not detected at the stop position.

7. The method of claim 6, wherein said step (f) includes carrying out the second spacing operation to an end position where the first spacing operation would have ended if the stoppage of the print head had not been detected, and wherein said method further comprises a step of effecting printing of a print medium during said third spacing operation in the second direction to the stop position.

* * * * *